US008624172B2

(12) United States Patent
Sweer

(10) Patent No.: US 8,624,172 B2
(45) Date of Patent: Jan. 7, 2014

(54) SHIFT LOCK ASSEMBLY

(75) Inventor: Grant Sweer, Saugus, CA (US)

(73) Assignee: Woodward HRT, Inc., Santa Clarita, CA (US)

( * ) Notice: Subject to any disclaimer, the term of this patent is extended or adjusted under 35 U.S.C. 154(b) by 693 days.

(21) Appl. No.: 12/903,434

(22) Filed: Oct. 13, 2010

(65) Prior Publication Data

US 2012/0091255 A1 Apr. 19, 2012

(51) Int. Cl.
*F42B 15/01* (2006.01)

(52) U.S. Cl.
USPC ..... 244/3.24; 244/3.27; 244/3.21; 74/325

(58) Field of Classification Search
USPC ..... 244/3.21, 3.27, 3.24, 49; 70/222, 223, 70/277, 278.7; 74/325
See application file for complete search history.

(56) References Cited

U.S. PATENT DOCUMENTS

| | | | | |
|---|---|---|---|---|
| 4,143,838 | A | 3/1979 | Holladay | |
| 4,296,895 | A | 10/1981 | Pazmany | |
| 4,404,714 | A * | 9/1983 | Duran | 24/652 |
| 4,601,442 | A * | 7/1986 | Friedel et al. | 244/3.24 |
| 4,795,110 | A * | 1/1989 | Lang | 244/3.24 |
| 5,007,762 | A * | 4/1991 | Duran | 403/341 |
| 5,607,250 | A | 3/1997 | Tatterson et al. | |
| 6,152,645 | A | 11/2000 | Sanford | |
| 6,186,443 | B1 | 2/2001 | Shaffer | |
| 6,206,432 | B1 | 3/2001 | Kamiyama | |
| 6,299,101 | B1 * | 10/2001 | Schroppel et al. | 244/3.21 |
| 6,726,147 | B1 * | 4/2004 | Perini et al. | 244/3.27 |
| 6,928,931 | B1 * | 8/2005 | Biserød | 102/377 |
| 6,948,685 | B2 * | 9/2005 | Hawthorne | 244/129.1 |
| 7,125,058 | B2 * | 10/2006 | Hawthorne | 294/82.28 |
| 7,316,370 | B2 * | 1/2008 | Sankovic et al. | 244/3.27 |
| 7,906,749 | B2 * | 3/2011 | Fjerstad | 244/3.24 |
| 2006/0278754 | A1 * | 12/2006 | Sankovic et al. | 244/3.27 |
| 2006/0289695 | A1 * | 12/2006 | Bois et al. | 244/3.24 |
| 2007/0049450 | A1 * | 3/2007 | Miller | 475/208 |
| 2007/0295044 | A1 * | 12/2007 | Tsukano et al. | 70/278.7 |
| 2009/0218437 | A1 * | 9/2009 | Sirimarco et al. | 244/3.21 |
| 2010/0264260 | A1 * | 10/2010 | Hammerquist | 244/49 |
| 2010/0314489 | A1 * | 12/2010 | Buckland et al. | 244/3.27 |
| 2011/0073705 | A1 * | 3/2011 | Huguenin et al. | 244/3.24 |

FOREIGN PATENT DOCUMENTS

| | | | |
|---|---|---|---|
| DE | 2418915 | A1 | 10/1975 |
| EP | 0441669 | A | 8/1991 |
| EP | 1191271 | A | 3/2002 |
| EP | 1265050 | A1 | 12/2002 |
| GB | 2150092 | A | 6/1985 |
| GB | 2214882 | A | 9/1989 |

* cited by examiner

*Primary Examiner* — Chrstopher P Ellis
*Assistant Examiner* — Medhat Badawi
(74) *Attorney, Agent, or Firm* — BainwoodHuang

(57) ABSTRACT

A shift lock assembly includes a drive member carried by a drive shaft and configured to rotatably couple to a drive motor and a shift mechanism disposed between the drive member and a ground plate, the shift mechanism configured to move between a first position and a second position relative to the drive member and the ground plate. When disposed in the first position, the shift mechanism is configured to couple the drive shaft to the ground plate and decouple the drive shaft from the drive member to allow rotation of the drive member relative to the drive shaft. When disposed in the second position, the shift mechanism is configured to couple the drive shaft to the drive member and decouple the drive shaft from the ground plate to allow rotation of the drive shaft in response to rotation of the drive member.

20 Claims, 6 Drawing Sheets

SHIFT LOCK ASSEMBLY

BACKGROUND

Conventional projectiles, such as bombs or missiles, have movable fins which help to steer the projectiles toward a particular target. In certain situations, such as prior to launch or during transportation, a locking mechanism holds the fins in a zero angle of attack position relative to the projectile's centerline. Such locking minimizes wear, overstressing, and the possibility of damage to the fins and associated steering systems. Additionally, the locking mechanism allows for release of the fins at the time of use so that the fins can be driven to computer controlled positions.

Conventional locking mechanisms can be transitioned from a locked state to an unlocked state in a variety of ways. For example, the locking mechanism can be configured as an explosive release mechanism having an explosive squib. The explosive squib can include a small tube that contains an explosive substance and a detonator disposed along a length of the tube. Initially, the explosive squib holds a release mechanism against the fins of the guided munitions to maintain the fins in an aligned or non-deployed position. When the detonator receives an electric discharge signal, the detonator detonates the explosive squib to release the lock mechanism. With such a release, the lock mechanism allows the fins to move from the non-deployed or locked position to a deployed position. Other conventional locking mechanisms include brakes, solenoids, and fin lock release motors configured to hold the fins in a retracted or stationary state and release the fins to allow the fins to move to a deployed position.

In addition to the locking mechanism, conventional projectiles can also include a driving mechanism to adjust the position of the fins during operation. For example, certain projectiles include a Control Actuation System (CAS) having an actuator, such as a motor, and an electronic controller, such as a flight computer. In use, the actuator is configured to adjust the position of the fins in response to steering commands received from the controller to steer the projectile along a flight path toward a target.

SUMMARY

As indicated above, certain conventional projectiles include both a locking mechanism and a driving mechanism to control operation of the projectile fins. With such a configuration, the use of conventional locking mechanisms can affect the overall cost, weight, and reliability associated with the projectiles.

For example, the locking mechanism can be configured as an explosive release mechanism. While conventional explosive release mechanisms have a minimal effect on the overall weight of a projectile, the explosive release mechanisms are one-time use devices that do not allow for resettability without incurring a relatively high replacement cost. Also, explosive devices have a reliability rating, thereby impacting the overall reliability of the projectile.

While other conventional locking mechanisms such as brakes, solenoids, and fin lock release motors are resettable, these locking mechanisms add to the cost and weight a projectile when taken in conjunction with the projectile's driving mechanism. Furthermore, one of these locking mechanisms can be added to a projectile as a distinct mechanical component, separate from the driving mechanism. The addition of a separate mechanical assembly can reduce the overall reliability and increase weight, power draw, and cost of the projectile with respect to the projectile's operation.

By contrast to conventional locking mechanisms, embodiments of the present invention relate to a shift lock assembly for each of projectile's fins. In one arrangement, a drive motor is configured to operate the shift lock assembly to unlock drive shaft that secures a set of projectile fins. Once disposed in an unlocked position, the same drive motor is further configured to operate the shift lock assembly to cause and the drive shaft to drive the projectile fins to commanded positions. The use of the shift lock assembly reduces the costs experienced with conventional locking mechanisms. For example, motors, electromechanically brakes, solenoids, and explosive devices found in conventional locking mechanisms are typically more expensive to procure and install compared to the shift lock assembly. Additionally, shift lock assembly weighs less than the motors and brakes found in conventional locking mechanisms. Accordingly use of the shift lock assembly can reduce the overall weight of the projectile, compared to conventional locking mechanisms. Furthermore, because the shift lock assembly adds relatively few mechanical components to the projectile, the reliability of the shift lock assembly is relatively higher than conventional locking mechanisms such as motors, solenoids, and explosive devices and their related drive electronics.

In one arrangement, a shift lock assembly includes a drive member carried by a drive shaft and configured to rotatably couple to a drive motor and a shift mechanism disposed between the drive member and a ground plate, the shift mechanism configured to move between a first position and a second position relative to the drive member and the ground plate. When disposed in the first position, the shift mechanism is configured to couple the drive shaft to the ground plate and decouple the drive shaft from the drive member to allow rotation of the drive member relative to the drive shaft. When disposed in the second position, the shift mechanism is configured to couple the drive shaft to the drive member and decouple the drive shaft from the ground plate to allow rotation of the drive shaft in response to rotation of the drive member.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Embodiments of the present invention relate to a shift lock assembly for each projectile fin. In one arrangement, a single drive motor is configured to operate the shift lock assembly to unlock a drive shaft that secures each projectile fin. Once disposed in an unlocked position, the drive motor is further configured to operate the shift lock assembly to cause and the drive shaft to drive the projectile's fin to a commanded position. The use of the shift lock assembly reduces the costs experienced with conventional locking mechanisms. For example, motors, electromechanically brakes, solenoids, and explosive devices found in conventional locking mechanisms are typically more expensive to procure and install compared to the shift lock assembly. Additionally, shift lock assembly weighs less than the motors and brakes found in conventional locking mechanisms. Accordingly use of the shift lock assembly can reduce the overall weight of the projectile, compared to conventional locking mechanisms. Furthermore, because the shift lock assembly adds relatively few mechanical components to the projectile, the reliability of the shift lock assembly is relatively higher than conventional locking mechanisms such as motors, solenoids, and explosive devices and their related drive electronics.

Figure 1:
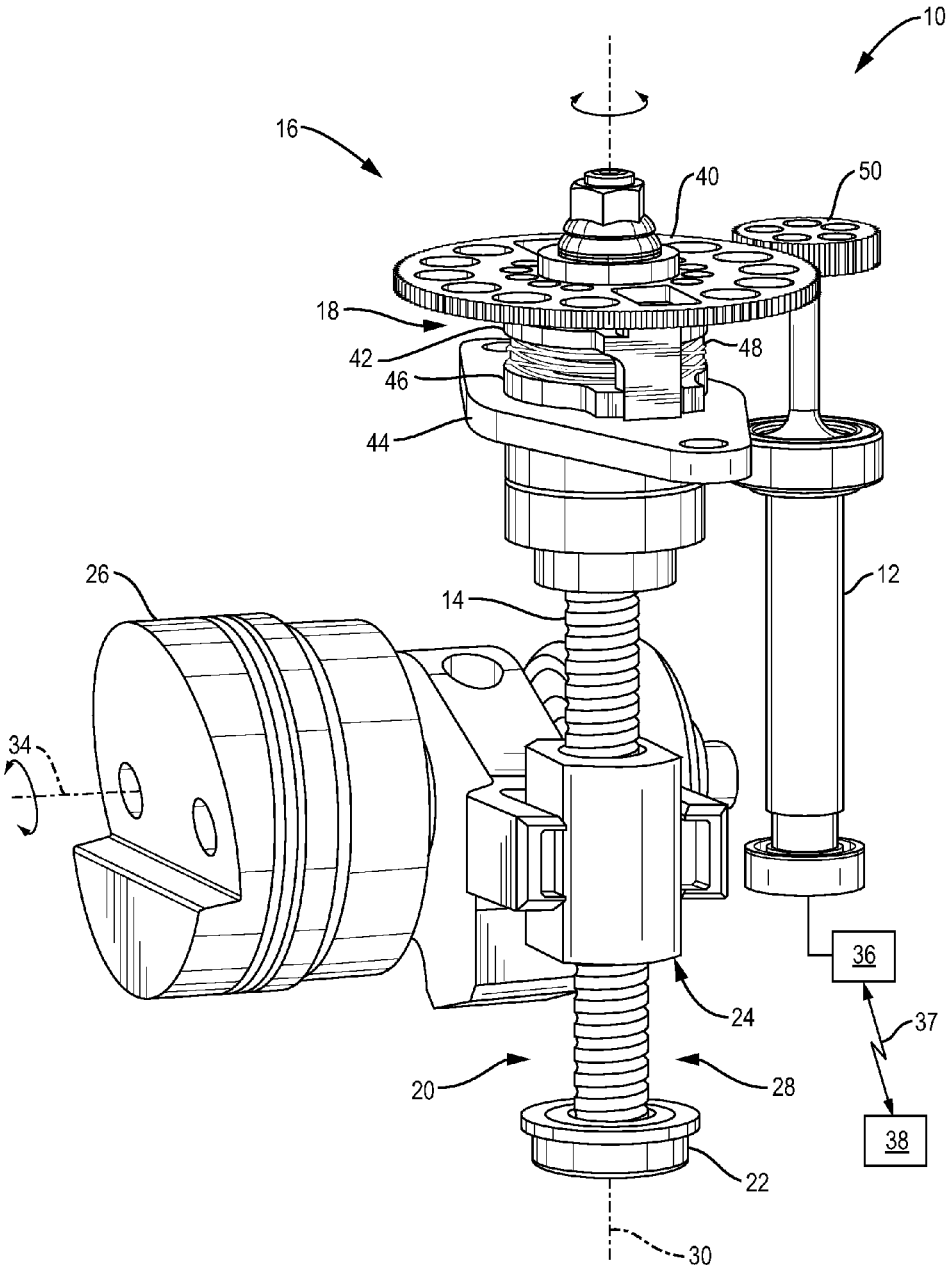
FIG. 1 illustrates a shift lock system, according to one arrangement.

FIG. 1 illustrates a shift lock system 10, according to one embodiment. The shift lock system 10 includes a drive motor 12, a drive shaft 14, and a shift lock assembly 16. As shown, the drive shaft 14 caries the shift lock assembly 16 at a first end 18 and has an opposing second end 20 rotatably carried by a base member 22. The drive shaft 14 also drives a ball nut 24 disposed between the first and second ends 18, 20. The ball nut 24 operatively couples the drive shaft 14 to an output shaft 26, such as a fin interface of one or more projectile fins. For example, as illustrated, the drive shaft 14 defines a set of threads 28 that extend along a longitudinal axis 30 of the drive shaft 14 and that mate with a corresponding set of threads disposed within the ball nut 24. As the drive shaft 14 rotates about a clockwise or counterclockwise direction relative to the base 22, intersection of the ball screw threads 28 and the crank arm housing threads (not shown) causes the ball nut 24 to translate along axis 30 to rotate the output shaft 26 in either a clockwise or counterclockwise direction about a longitudinal axis 34.

The motor 12 is configured to mechanically couple to the shift lock assembly 16 to both unlock the drive shaft 14 from a locked position and to drive the drive shaft 14 to position the output shaft 26. For example, the motor 12 is disposed in electrical communication with a controller 36, such as a processor and memory, which receives load positioning signals 37 from a flight control center 38. While the flight control center 38 can provide the signals 37 in a variety of ways, in one arrangement, the flight control center 38 provides the signals 37 from a remote location. Based upon the signals 37 received by the controller 36, the controller 36 commands the motor 12 to adjust the position of the drive shaft 14, via the shift lock assembly 16, to move the load 26 to a desired position. For example, when used as part of a projectile, such as a missile, the controller 36 commands the motor 12 to adjust the position of the fins through the output shaft 26 to steer the projectile towards a target.

Figure 2:
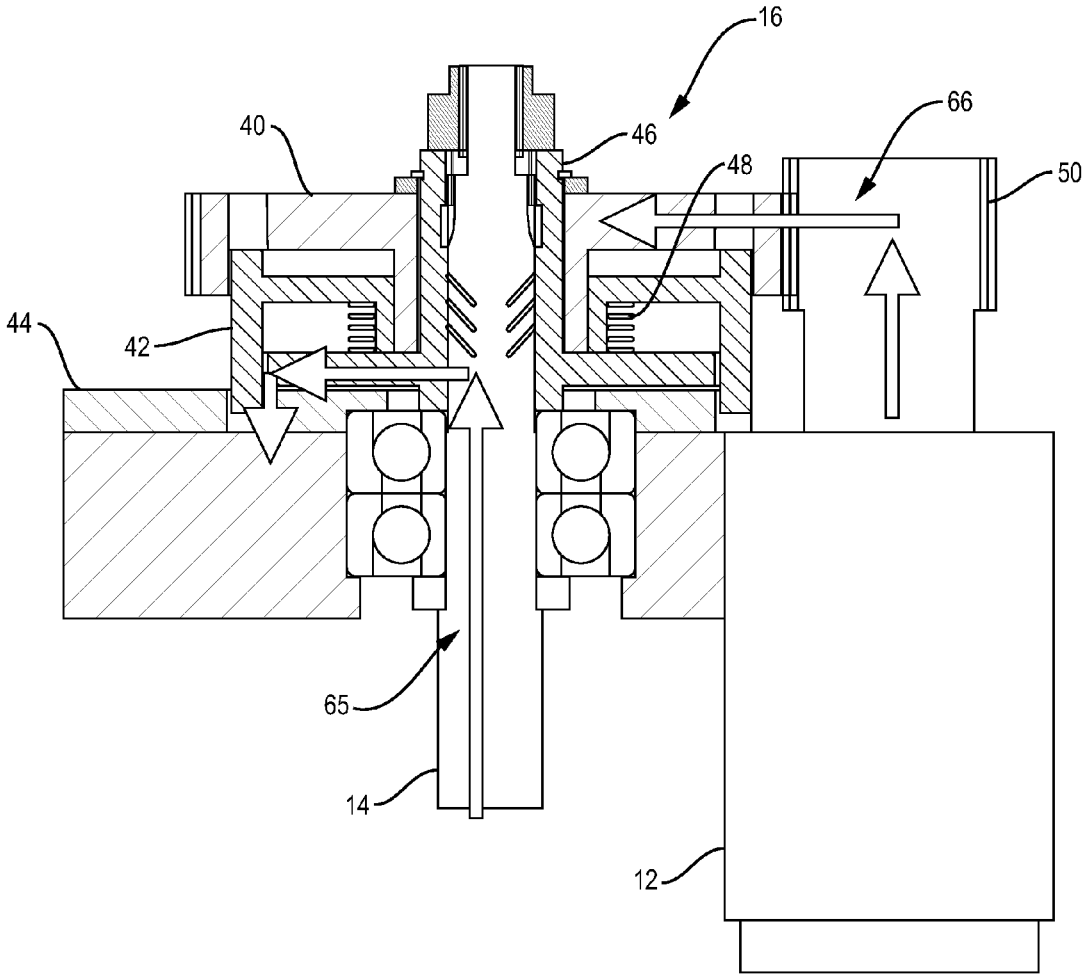
FIG. 2 illustrates a sectional view of a shift lock assembly of the shift lock system of FIG. 1 with a drive shaft disposed in a locked position.
Figure 3:
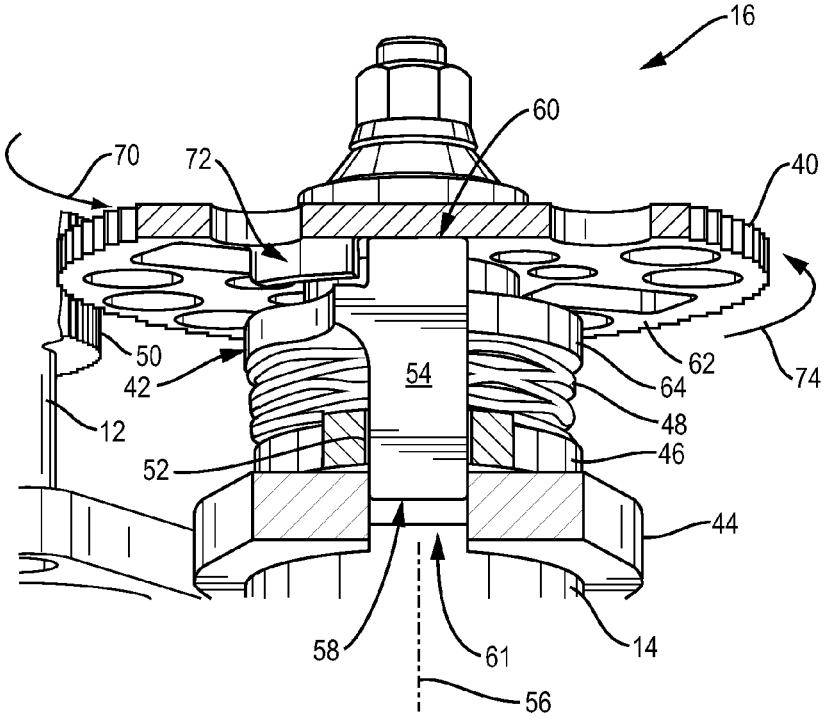
FIG. 3 illustrates a partial sectional view of the shift lock assembly of FIG. 1, with a shift lock disposed in a first position between a drive member and a ground plate.

As shown in FIGS. 1-3, an arrangement of the shift lock assembly 16 includes a drive member 40, a shift mechanism 42 disposed between the drive member 40 and a ground plate 44, and an drive shaft drive mechanism 46 coupled to the drive shaft 14. As indicated in FIG. 1, the ground plate 44 is configured to be secured to an object, such as a projectile housing, to minimize movement of the ground plate 44 relative to the shift lock assembly 16 during operation.

In one arrangement, the drive member 40 is configured to rotatably couple to the drive motor 12. For example, the drive mechanism 40 is configured as a gear having teeth that mesh with the corresponding teeth of a gear 50 carried by the motor 12. As the gear 50 of the motor 12 rotates in a counterclockwise direction, the drive member 40, in response, rotates in a clockwise direction. The drive member 40 is configured to operate in conjunction with the shift mechanism 42, as will be described below, to unlock the drive shaft 14 from a locked state and to drive the drive shaft 14 and corresponding output shaft 26 to a commanded position.

Figure 4:
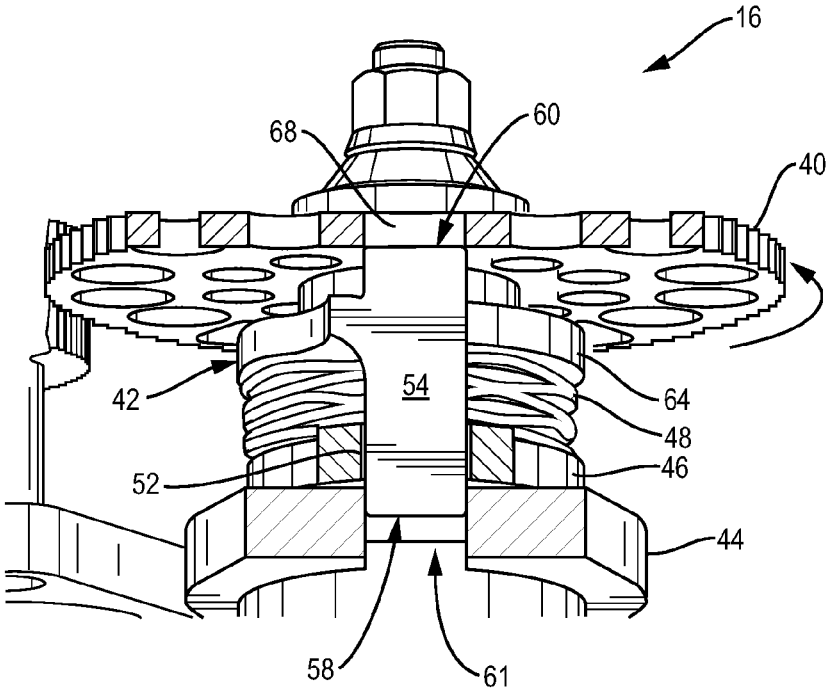
FIG. 4 illustrates the partial sectional view of the shift lock assembly of FIG. 3 with the shift lock transitioning from the first position to a second position between the drive member and the ground plate.
Figure 5:
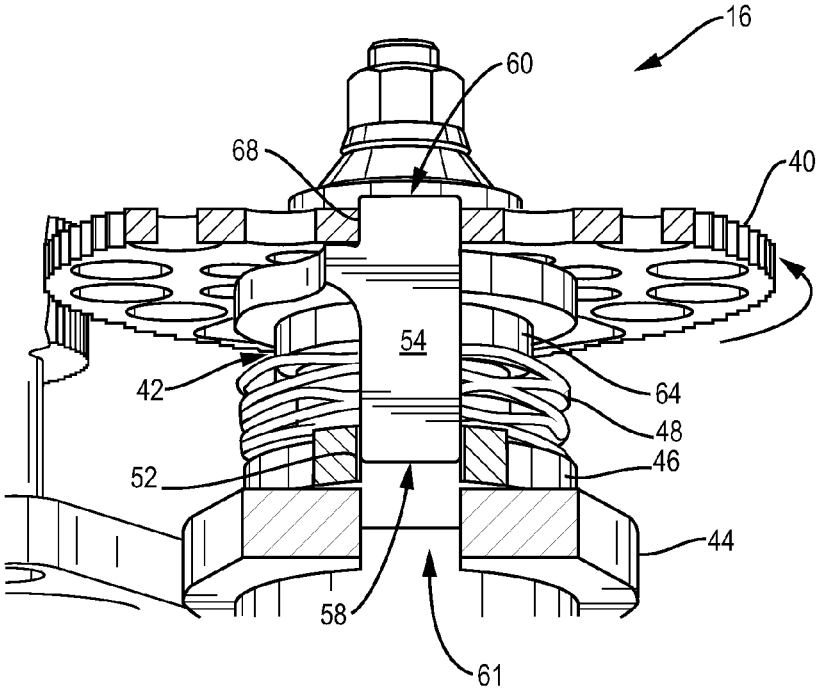
FIG. 5 illustrates the partial sectional view of the shift lock assembly of FIG. 3 with the shift lock disposed in a second position between the drive member and the ground plate.
Figure 6:
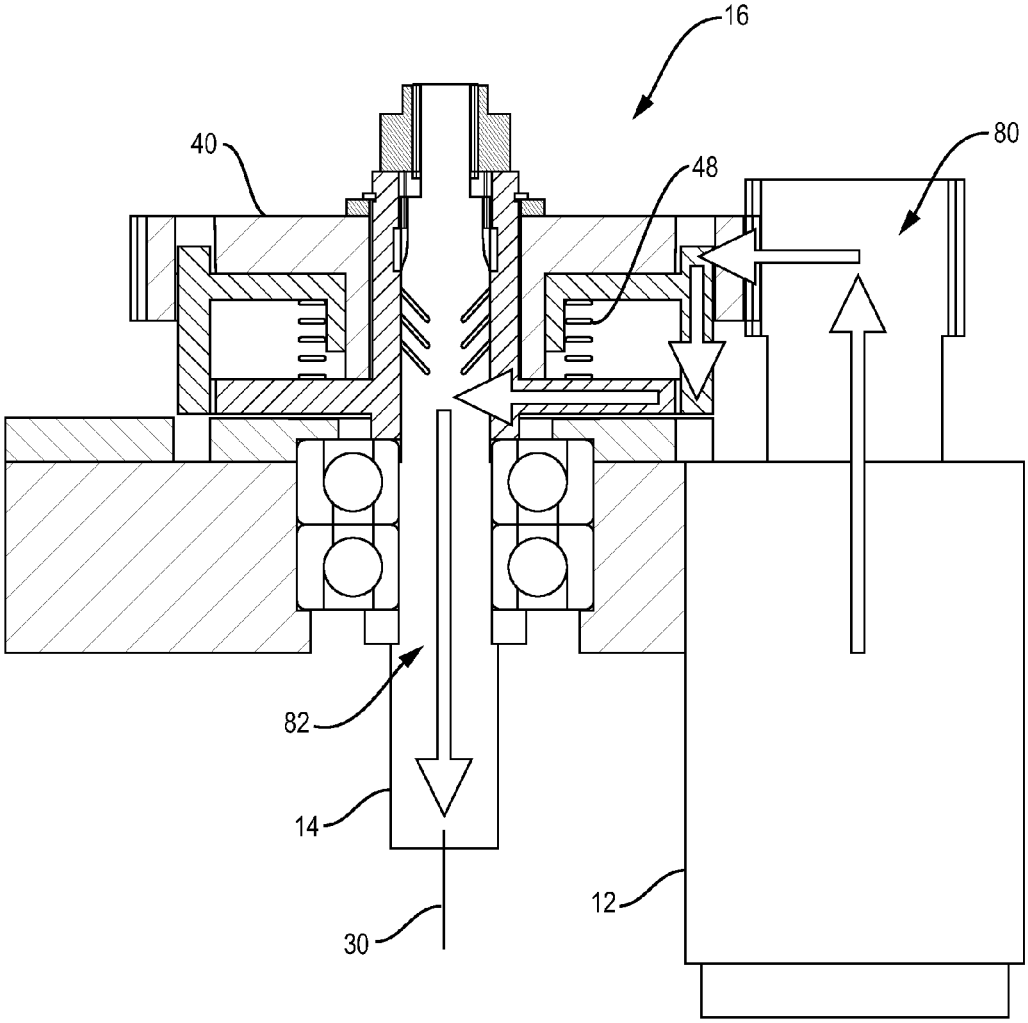
FIG. 6 illustrates a sectional view of a shift lock assembly of the shift lock system of FIG. 1 with the drive shaft disposed in an unlocked position

The shift mechanism 42 configured to move between a first position and a second position relative to the drive member 40 and the ground plate 44 to selectively couple the drive shaft drive mechanism 46 to one of the ground plate 44 and the drive member 40. For example, the shift mechanism 42 includes a spring 48 disposed between the shift mechanism 42 and a portion of the drive shaft drive mechanism 46 as well as the ground plate 44. As will be described above, expansion of the spring 48 from a compressed state, as shown in FIGS. 2-4, to an expanded state, as shown in FIGS. 5 and 6, translates the shift mechanism 42 along the longitudinal axis 30 of the drive shaft 14 from the first position (shown in FIGS. 2-4) to the second position (shown in FIGS. 5 and 6). While the spring 48 can be configured in a variety of ways, in one arrangement, the spring 48 has a biased-open configuration and is configured to generate a force of about five pounds when compressed between the shift mechanism 42 and the ground plate 44.

As indicated above, the drive shaft drive mechanism 46 is coupled to the drive shaft 14 at the first end 18. While the drive shaft drive mechanism 46 can be coupled to the drive shaft 14 in a variety of ways, in one arrangement, the drive shaft drive mechanism 46 is splined and fastened, such as via a bolt, to the drive shaft 14. Furthermore, the shift mechanism 42 is moveably coupled to the drive shaft drive mechanism 46. For example, as shown in FIGS. 3-5, the drive shaft drive mechanism 46 defines an opening or slot 52 configured to contain at least part of a mating support 54 extending from the shift mechanism 42 along an axis 56 that is substantially parallel to the longitudinal axis 30 of the drive shaft 14. Interaction between the slot 52 and the mating support 54 secures the drive shaft drive mechanism 46 to the shift mechanism 42 when the shift mechanism 42 couples the drive shaft drive mechanism 46 to either the ground plate 44 or the drive member 40.

FIGS. 3-5 illustrate operation of the shift lock assembly 16, according to one embodiment. In an initial state, as illustrated in FIGS. 2 and 3, the shift mechanism 42 is disposed in a first position to secure or lock the position of the drive shaft 14 thereby minimizing rotation of the drive shaft 14 and corresponding movement of the attached output shaft 26. For example, the shift mechanism 42 includes a ground plate mating portion 58 disposed at an end of the mating support 54 and a drive member mating portion 60 disposed at an opposing end of the mating support 54. In the first position, as shown, the ground plate mating portion 58 is disposed within a mating opening 61 defined by the ground plate 44 with the mating support 54 aligned with the slot 52 of the drive shaft drive mechanism 46. Also in the first position, the drive member mating portion 60 abuts an opposing face 62 of the drive member 40.

With such positioning, the face 62 of the drive member 40 pushes against the drive member mating portion 60, thereby causing a ring 64 of the shift mechanism 42 to compress the spring 48 against the drive shaft drive mechanism 46. Furthermore, with the ground plate mating portion 58 disposed within the ground plate mating portion 58 and the mating support 54 disposed within the slot 52 of the drive shaft drive mechanism 46, and with reference to FIG. 2, the shift mechanism 42 couples the drive shaft drive mechanism 46 to the ground plate 44, as indicated by arrows 65. Accordingly, during an initial phase of operation, as the motor 12 rotates gear 50, because the shift mechanism 42 is decoupled from the drive member 40, the drive member 40 can rotate relative to the drive shaft 14 and the drive shaft drive mechanism 46 without causing either the drive shaft 14 or the drive shaft drive mechanism 46 to rotate.

In a subsequent state, as illustrated in FIGS. 4-6, the shift mechanism 42 is disposed in a second position to couple the drive shaft 14 to the drive member 40 and decouple the drive shaft 14 from the ground plate 44 to allow rotation of the drive shaft 14 in response to rotation of the drive member 40. For example, the drive member 40 defines a mating opening 68, such as extending from the face 62 of the drive member 40. When the mating opening 68 aligns with the drive member mating portion 60 of the shift mechanism 42, such alignment allows the shift mechanism 42 to translate from the first position to the second position, as will be described in detail below.

For example, in the case where an operator wants to unlock the drive shaft 14, with reference to FIGS. 1 and 3, the operator transmits a control signal 37 to the controller 36 to cause the motor 12 to rotate the drive member 40 along a clockwise direction. In response, the drive member 40 rotates to a first rotational position when a stop portion 72 extending from the face 62 of the drive member 40 abuts the drive member mating portion 60. At this point, the operator provides a control signal 37 to the controller 36 to cause the motor 12 to rotate the drive member 40 along a clockwise direction 74 for a particular number of Hall counts to a second rotational position. At the second rotational position, the mating opening 68 of the drive member 40 aligns with the drive member mating portion 60 of the shift mechanism 42, as illustrated in FIG. 4.

With the mating opening 68 aligned with the drive member mating portion 60, the spring 48 expands along the longitudinal axis 30 of the drive shaft 14, as indicated in FIGS. 5 and 6, to push the ring 64 toward the face 62 of the drive member 40, insert the drive member mating portion 60 of the shift mechanism 42 into the mating opening 68 of the drive member 40, and disengage the mating support 54 from the ground plate mating portion 58. With such positioning, the shift mechanism 42 couples the drive shaft 14 to the drive member 40 and decouples the drive shaft 14 from the ground plate 44 to unlock the drive shaft 14. With the drive shaft 14 coupled to both the drive member 40 and the drive shaft drive mechanism 46 via the shift mechanism 42, continued rotation of the drive member 40 by the motor 12, indicated as arrows 80 in FIG. 6 drives the drive shaft 14, as indicated by arrows 82, and positions an associated output shaft 26 at a particular commanded position.

As indicate above, the use of the shift ring assembly 16 allows a single motor 12 to drive both an drive shaft locking mechanism and an output shaft positioning mechanism. Accordingly, use of the shift lock assembly reduces the costs experienced with conventional locking mechanisms and reduces the overall weight of the projectile, compared to conventional locking mechanisms.

While various embodiments of the invention have been particularly shown and described, it will be understood by those skilled in the art that various changes in form and details may be made therein without departing from the spirit and scope of the invention as defined by the appended claims.

For example, as indicated above, the shift ring assembly 16 is disposed at a first end 18 of the drive shaft 14. Such indication is by way of example only. In one arrangement, the shift lock assembly 16 can be placed at any location relative to the drive motor 12 to properly balance inertia, backlash, and loads.

As indicated above, the shift ring assembly 16 is utilized to both lock and allow positioning of projectile fins in a projectile. Such indication is by way of example only. The shift lock assembly 16 can be applied to any mechanical system that requires a load to be locked into a position, such as for transportation and storage, and then shifted into an operational state where a motor can drive it to a commanded position using only the motor power that drives the load.

What is claimed is:

1. A shift lock assembly, comprising:

a drive member carried by a drive shaft and configured to rotatably couple to a drive motor; and a shift mechanism disposed between the drive member and a ground plate, the shift mechanism configured to move between a first position and a second position relative to the drive member and the ground plate;

when disposed in the first position, the shift mechanism is configured to couple the drive shaft to the ground plate and decouple the drive shaft from the drive member to allow rotation of the drive member relative to the drive shaft;

when disposed in the second position, the shift mechanism is configured to couple the drive shaft to the drive member and decouple the drive shaft from the ground plate to allow rotation of the drive shaft in response to rotation of the drive member.

2. The shift lock assembly of claim 1, wherein the shift mechanism comprises a drive member mating portion, the drive member mating portion configured to abut a portion of the drive member when the drive member is disposed in a first rotational position relative to the shift mechanism and is configured to engage the drive member when the drive member is disposed in a second rotational position relative to the shift mechanism.

3. The shift lock assembly of claim 2, wherein:

the drive member defines a mating opening; and the drive member mating portion is configured to position within the mating opening defined by the drive member when the drive member is disposed in the second rotational position relative to the shift mechanism.

4. The shift lock assembly of claim 1, wherein the shift mechanism comprises a ground plate mating portion, the ground plate (i) engaging the ground plate mating portion when the drive member is disposed in a first rotational position relative to the shift mechanism and (ii) disengaging from the ground plate mating portion when the drive member is disposed in a second rotational position relative to the shift mechanism.

5. The shift lock assembly of claim 4, wherein:

the ground plate defines a mating opening; and the ground plate mating portion is configured to position within the mating opening defined by the ground plate when the drive member is disposed in the first rotational position relative to the shift mechanism.

6. The shift lock assembly of claim 1, comprising a drive shaft drive mechanism coupled to the drive shaft, the shift mechanism moveably coupled to the drive shaft drive mechanism to selectively couple the drive shaft drive mechanism to one of the ground plate and the drive member.

7. The shift lock assembly of claim 1, comprising a spring disposed between the shift mechanism and the ground plate, the spring disposed in a compressed state when the drive member is disposed in a first rotational position relative to the shift mechanism and the spring disposed in an expanded state when the drive member is disposed in a second rotational position relative to the shift mechanism.

8. The shift lock assembly of claim 1, wherein the shift mechanism is configured to move along a longitudinal axis of the drive shaft between a first position and a second position relative to the drive member and the ground plate.

9. A shift lock system, comprising:

a drive shaft;

a drive motor; and a shift lock assembly carried by the drive shaft, the shift lock assembly having:

a drive member carried by the drive shaft and configured to rotatably couple to a drive motor; and a shift mechanism disposed between the drive member and a ground plate, the shift mechanism configured to move between a first position and a second position relative to the drive member and the ground plate;

when disposed in the first position, the shift mechanism is configured to couple the drive shaft to the ground plate and decouple the drive shaft from the drive member to allow rotation of the drive member relative to the drive shaft;

when disposed in the second position, the shift mechanism is configured to couple the drive shaft to the drive member and decouple the drive shaft from the ground plate to allow rotation of the drive shaft in response to rotation of the drive member.

10. The shift lock system of claim 9, wherein the shift mechanism comprises a drive member mating portion, the drive member mating portion configured to abut a portion of the drive member when the drive member is disposed in a first rotational position relative to the shift mechanism and is configured to engage the drive member when the drive member is disposed in a second rotational position relative to the shift mechanism.

11. The shift lock system of claim 10, wherein:

the drive member defines a mating opening; and the drive member mating portion is configured to position within the mating opening defined by the drive member when the drive member is disposed in the second rotational position relative to the shift mechanism.

12. The shift lock system of claim 9, wherein the shift mechanism comprises a ground plate mating portion, the ground plate (i) engaging the ground plate mating portion when the drive member is disposed in a first rotational position relative to the shift mechanism and (ii) disengaging from the ground plate mating portion when the drive member is disposed in a second rotational position relative to the shift mechanism.

13. The shift lock system of claim 12, wherein:

the ground plate defines a mating opening; and the ground plate mating portion is configured to position within the mating opening defined by the ground plate when the drive member is disposed in the first rotational position relative to the shift mechanism.

14. The shift lock system of claim 9, comprising an drive shaft drive mechanism coupled to the drive shaft, the shift mechanism moveably coupled to the drive shaft drive mechanism to selectively couple the drive shaft drive mechanism to one of the ground plate and the drive member.

15. The shift lock system of claim 9, comprising a spring disposed between the shift mechanism and the ground plate, the spring disposed in a compressed state when the drive member is disposed in a first rotational position relative to the shift mechanism and the spring disposed in an expanded state when the drive member is disposed in a second rotational position relative to the shift mechanism.

16. The shift lock system of claim 9, wherein the shift mechanism is configured to move along a longitudinal axis of the drive shaft between a first position and a second position relative to the drive member and the ground plate.

17. The shift lock system of claim 9, wherein the drive shaft comprises a first end and a second end opposing the first end, the first end configured to carry the shift lock assembly and the second end coupled to an output shaft, rotation of the drive shaft between a first position and a second position configured to move the output shaft between a first position and a second position.

18. The shift lock system of claim 17, wherein the output shaft is coupled to at least one fin of a projectile.

19. The shift lock system of claim 17, comprising a controller disposed in electrical communication with the motor, the controller configured to provide a drive signal to the motor (i) to cause the motor to rotate the drive member between the first position and the second position to couple the drive shaft to the drive member and decouple the drive shaft from the ground plate to allow rotation of the drive shaft in response to rotation of the drive member and (ii) to cause the motor to rotate the drive member and drive shaft to position an output shaft to a commanded position corresponding to the drive signal.

20. A method, comprising disposing a drive member in a first rotational position to cause a shift mechanism to couple a drive shaft to a ground plate and decouple the drive shaft from the drive member to allow rotation of the drive member relative to the drive shaft;

disposing the drive member in a second rotational position to cause the shift mechanism to couple the output shaft to the drive member and decouple the output shaft from the ground plate; and continuing to rotate the drive member to position the drive shaft and an output shaft coupled to the drive shaft in response to rotation of the drive member.

* * * * *